US010857659B2

(12) United States Patent
Saur

(10) Patent No.: US 10,857,659 B2
(45) Date of Patent: Dec. 8, 2020

(54) HANDHELD POWER TOOL DEVICE

(71) Applicant: Robert Bosch GmbH, Stuttgart (DE)

(72) Inventor: Dietmar Saur, Moessingen (DE)

(73) Assignee: Robert Bosch GmbH, Stuttgart (DE)

( * ) Notice: Subject to any disclaimer, the term of this patent is extended or adjusted under 35 U.S.C. 154(b) by 184 days.

(21) Appl. No.: 15/801,408

(22) Filed: Nov. 2, 2017

(65) Prior Publication Data

US 2018/0147711 A1 May 31, 2018

(30) Foreign Application Priority Data

Nov. 29, 2016 (DE) ..... 10 2016 223 678

(51) Int. Cl.
*B25F 5/00* (2006.01)
*B25F 5/02* (2006.01)

(52) U.S. Cl.
CPC ..... *B25F 5/001* (2013.01); *B25F 5/02* (2013.01)

(58) Field of Classification Search
CPC . B25F 5/001; B25F 5/02; B23Q 5/027; B25D 11/102; B25D 11/104
USPC ..... 173/90, 104, 109, 48, 176, 178
See application file for complete search history.

(56) References Cited

U.S. PATENT DOCUMENTS 4,088,197 A * 5/1978 Roll ..... B25B 23/145 173/178
5,449,043 A * 9/1995 Bourner ..... B25B 23/1405 173/178
2003/0149508 A1* 8/2003 Watanabe ..... B25B 23/1405 700/168
2005/0173139 A1* 8/2005 Furuta ..... B25D 16/006 173/48
2007/0181321 A1* 8/2007 Ha ..... B25D 17/005 173/122
2010/0326687 A1* 12/2010 Roehm ..... B25D 16/006 173/48
2014/0158390 A1* 6/2014 Mashiko ..... B25B 21/00 173/47
2014/0318286 A1* 10/2014 Seebauer ..... F16H 25/16 74/55
2014/0374130 A1* 12/2014 Nakamura ..... B25D 11/00 173/176
2014/0374131 A1* 12/2014 Hirabayashi ..... B25B 21/008 173/181
2015/0231770 A1* 8/2015 Kusakawa ..... B25B 23/1475 173/93.5

(Continued)

FOREIGN PATENT DOCUMENTS

CN 101332518 A 12/2008
CN 101516577 A 8/2009

(Continued)

*Primary Examiner* — Chelsea E Stinson
*Assistant Examiner* — Himchan Song
(74) *Attorney, Agent, or Firm* — Norton Rose Fulbright US LLP; Gerard Messina

(57) ABSTRACT

A handheld power tool device having a drive unit, which includes at least one driveshaft, and at least one rotary percussion mechanism, which includes at least one intermediate shaft oriented at least essentially flush with respect to the driveshaft, and at least two bearings for mounting the driveshaft. It is provided that the bearings for mounting the driveshaft are situated on a side of the drive unit facing toward the rotary percussion mechanism.

14 Claims, 6 Drawing Sheets

(56) References Cited

U.S. PATENT DOCUMENTS

| | | | | |
|---|---|---|---|---|
| 2015/0343617 | A1* | 12/2015 | Kondo | B25F 5/00 173/93 |
| 2017/0157752 | A1* | 6/2017 | Nishimiya | B25B 21/008 |

FOREIGN PATENT DOCUMENTS

| | | | |
|---|---|---|---|
| CN | 102829161 | A | 12/2012 |
| EP | 2480379 | A1 | 8/2012 |

* cited by examiner

HANDHELD POWER TOOL DEVICE

CROSS REFERENCE

The present application claims the benefit under 35 U.S.C. § 119 of German Patent Application No. DE 102016223678.4 filed on Nov. 29, 2016, which is expressly incorporated herein by reference.

BACKGROUND INFORMATION

A handheld power tool device having a drive unit, which has at least one drive shaft, and at least one rotary percussion mechanism, which includes at least one intermediate shaft, which is oriented at least essentially flush with respect to the driveshaft, and at least two bearings for mounting the driveshaft, is conventional.

SUMMARY

The present invention is directed to a handheld power tool device having a drive unit, which has at least one drive shaft, and at least one rotary percussion mechanism, which includes at least one intermediate shaft, which is oriented at least essentially flush with respect to the driveshaft, and at least two bearings for mounting the driveshaft.

It is provided that the bearings for mounting the driveshaft are arranged on a side of the drive unit facing toward the rotary percussion mechanism.

A "handheld power tool device" is to be understood in this context in particular as at least one part, in particular a subassembly, of a handheld power tool. In particular, the handheld power tool device may also include the entire handheld power tool. The handheld power tool may be designed as any arbitrary, advantageously electrical machine, but advantageously as a rotary impact screwdriver. A "drive unit" is to be understood in particular as a unit which is provided to convert electrical energy in particular into kinetic energy, in particular rotational energy. The drive unit is designed in particular at least essentially as an electric motor, in particular as a caseless electric motor. The driveshaft is at least partially formed in particular by an armature shaft of the caseless electric motor. "At least essentially flush" is to be understood here in particular as an orientation of the driveshaft and the intermediate shaft in relation to one another, the driveshaft and the intermediate shaft, viewed along an axial direction, being situated at least essentially overlapping the driveshaft and/or the intermediate shaft. "Provided" is to be understood in particular as especially programmed, designed, and/or equipped. An object being provided for a specific function is to be understood in particular to mean that the object fulfills and/or executes this specific function in at least one application state and/or operating state. A "rotary percussion mechanism" is to be understood in this context in particular as a percussion mechanism which is provided to convert an at least essentially continuous power output of a drive unit into a percussion angular momentum. The rotary percussion mechanism may be designed in particular as a cam rotary percussion mechanism or as a V-groove rotary percussion mechanism.

An "intermediate shaft" is to be understood in particular as a shaft of a drivetrain, which is situated in particular between a drive unit and an output shaft, in particular of a handheld power tool. In particular, the at least one intermediate shaft is provided for transmitting a force and/or movement, which is in particular generated by the drive unit, directly and/or indirectly to the output shaft. A "bearing" is to be understood in this context in particular as a radial bearing, which is provided for rotatably mounting the driveshaft in relation to the intermediate shaft. In particular, the bearings for mounting the drive axle may be designed as slide bearings and/or antifriction bearings. The bearings for mounting the drive axle are preferably at least partially designed as antifriction bearings, for example, as ball bearings, roller bearings, or needle bearings. In particular, the handheld power tool device is free of bearings for mounting the driveshaft which are situated on a side of the drive unit facing away from the rotary percussion mechanism.

A generic handheld power tool device having advantageous design properties may be provided by such a design.

In particular, an advantageously compact configuration, in particular an advantageously short overall length of the mounting of the driveshaft and/or an advantageously short overall length of the handheld power tool device may be achieved by the arrangement of the bearings for mounting the driveshaft inside the intermediate shaft. Furthermore, an advantageously short tolerance chain with respect to a mounting of the driveshaft may be achieved. Moreover, a mounting of the driveshaft in a housing of the handheld power tool may be omitted, whereby the housing may advantageously be simply designed and/or a short tolerance chain may be achieved for the arrangement of the handheld power tool device.

Furthermore, it is provided that the bearings for mounting the driveshaft are situated inside the rotary percussion mechanism. In this way, an advantageously compact configuration, in particular an advantageously short overall length of the handheld power tool device may be achieved. The bearings for mounting the driveshaft being situated inside the rotary percussion mechanism is to be understood to mean in particular that the bearings are enclosed at least essentially completely in particular in the circumferential direction by at least one element of the rotary percussion mechanism. In particular, the bearings for mounting the drive axle may be formed at least partially in one piece with at least one element of the rotary percussion mechanism and/or may rest against at least one surface of an element of the rotary percussion mechanism at least partially with a circumference, in particular an outer circumference. In particular, the bearings may be pressed at least partially into at least one element of the rotary percussion mechanism and/or may be inserted at least partially into at least one element of the rotary percussion mechanism and/or may be secured with the aid of at least one securing element, in particular with the aid of a snap ring, inside at least one element of the rotary percussion mechanism. "In one piece" is to be understood in particular as at least integrally joined, for example, by a welding process, an adhesive bonding process, an extrusion process, and/or another process which appears reasonable to those skilled in the art, and/or is advantageously understood as molded in one piece, for example, by manufacturing from a casting and/or by manufacturing in a single-component or multicomponent injection molding method and advantageously from a single blank.

Furthermore, it is provided that the rotary percussion mechanism includes at least one planetary gear having a plurality of planetary wheels interlocked with the driveshaft, the toothing of the driveshaft with the planetary wheels being situated between the bearings for mounting the driveshaft. A "planetary gear" is to be understood in particular as a gear which has at least one planet connected to a planet carrier, which is coupled in the radial direction toward the outside to an annulus gear and/or in the radial direction toward the inside to a sun wheel. The sun wheel, the planet, and/or the annulus gear may be formed in particular by round gearwheels or by out-of-center gearwheels which are coordinated. Multiple planetary gears may be connected in succession and/or multiple stages may be interconnected between planetary wheel and annulus gear. An "annulus gear" is to be understood in particular as a gear wheel which has a collar, which is designed in the form of a cylindrical jacket or in the form of an interrupted cylindrical jacket. In particular, the bearings for mounting the driveshaft are situated in the immediate vicinity of the toothing. In particular, "immediate vicinity of the toothing" is to be understood as an area which is situated spaced apart by less than 5 cm, advantageously less than 2.5 cm, and particularly advantageously less than 1.5 cm from at least one part of the toothing. The intermediate shaft is designed in particular at least partially as a planetary wheel carrier of the planetary gear. Advantageously good concentricity of the planetary gear of the rotary percussion mechanism may be achieved in this way.

Furthermore, it is provided that the driveshaft is mounted at least partially inside the intermediate shaft. The intermediate shaft preferably has at least one receptacle recess, which is provided for at least partially accommodating the driveshaft. In particular, the receptacle recess extends along a rotation axis of the intermediate shaft. In particular in an installed state, the driveshaft protrudes at least partially into the intermediate shaft, in particular into the receptacle recess of the intermediate shaft. At least one of the bearings for mounting the driveshaft is preferably situated inside the intermediate shaft. At least one bearing for mounting the driveshaft is preferably at least partially, advantageously completely situated inside the receptacle recess of the intermediate shaft. An advantageously low-friction mounting of the driveshaft may be achieved in this way. Furthermore, by arranging the bearing inside the receptacle recess, an advantageously short overall length of the rotary percussion mechanism may be achieved. An advantageously short overall length of the handheld power tool device may be achieved in this way.

In one embodiment of the present invention, it is provided that at least one bearing for mounting the driveshaft is situated inside at least one element of the rotary percussion mechanism which is different from an intermediate shaft. The rotary percussion mechanism preferably includes at least one percussion mechanism cover and at least one bearing for mounting the driveshaft is situated inside the percussion mechanism cover. A "percussion mechanism cover" is to be understood in this context in particular as a cover element which is provided for at least largely closing the rotary percussion mechanism in a direction of at least one further handheld power tool unit, in particular in the direction of a drive unit. "At least largely" is to be understood in this context in particular as at least 51%, preferably at least 65%, and particularly preferably at least 75%. In particular, the percussion mechanism cover has at least one lead-through recess, which is provided for at least partially leading through at least one shaft, in particular a driveshaft. In particular, the percussion mechanism cover may be formed in one piece with an annulus gear of the planetary gear. At least one bearing for mounting the driveshaft being situated inside an element of the rotary percussion mechanism, in particular inside the percussion mechanism cover, is to be understood in particular to mean that at least one bearing for mounting the driveshaft is at least essentially enclosed by the element of the rotary percussion mechanism in the circumferential direction. The element of the rotary percussion mechanism, in particular the percussion mechanism cover, has at least one bearing receptacle, which is provided for receiving the bearing for mounting the driveshaft. A "bearing receptacle" is to be understood in this context in particular as an area formed at least partially by the percussion mechanism cover, which is provided for a fixed arrangement of the bearing for mounting the driveshaft inside the element of the rotary percussion mechanism. The bearing receptacle is in particular formed in one piece with the element of the rotary percussion mechanism. In particular, an internal diameter of the bearing receptacle at least essentially corresponds to an external diameter of the bearing for mounting the driveshaft. The bearing for mounting the driveshaft is preferably fixed by a press fit in the bearing receptacle. A "press fit" is to be understood in particular as a force-locked connection which may be designed as a transverse and/or longitudinal interference fit. A "force-locked connection" is to be understood in particular as a detachable connection, a retention force between two components preferably being transmitted by a friction force between the components. An advantageously simple, secure, and/or permanent arrangement of at least one bearing for mounting the driveshaft may be achieved in this way.

In one preferred embodiment of the present invention, it is provided that all bearings for mounting the driveshaft are situated inside the intermediate shaft. In particular, the intermediate shaft has at least one bearing receptacle, which is situated at least essentially directly at an insertion opening of the receptacle recess of the intermediate shaft, which is provided for inserting a driveshaft into the intermediate shaft. The bearing receptacle is provided in particular for at least partially accommodating at least one bearing for mounting the driveshaft. In particular, at least one further bearing for mounting the driveshaft is situated at an end of the receptacle recess of the intermediate shaft opposite to the insertion opening. An advantageously simple, secure, and/or permanent arrangement of the bearings for mounting the driveshaft may be achieved in this way.

Moreover, a handheld power tool, in particular a rotary impact screwdriver, having at least one handheld power tool device according to the present invention is provided. An advantageously compact hand-held power tool, in particular an advantageously compact rotary impact screwdriver, may be provided in this way. In particular, the handheld power tool may have an advantageously short overall length.

The handheld power tool device according to the present invention is not to be restricted in this case to the above-described application and specific embodiment. In particular, the handheld power tool device according to the present invention may have a number of individual elements, components, and units, which deviates from a number mentioned herein to fulfill a functionality described herein.

BRIEF DESCRIPTION OF THE DRAWINGS

Further advantages result from the description below of the figures. Three exemplary embodiments of the present invention are shown in the figures. The figures and the description herein contain numerous features in combination. Those skilled in the art will advantageously also consider the features individually and combine them into reasonable further combinations.

DETAILED DESCRIPTION OF EXAMPLE EMBODIMENTS

Figure 1:
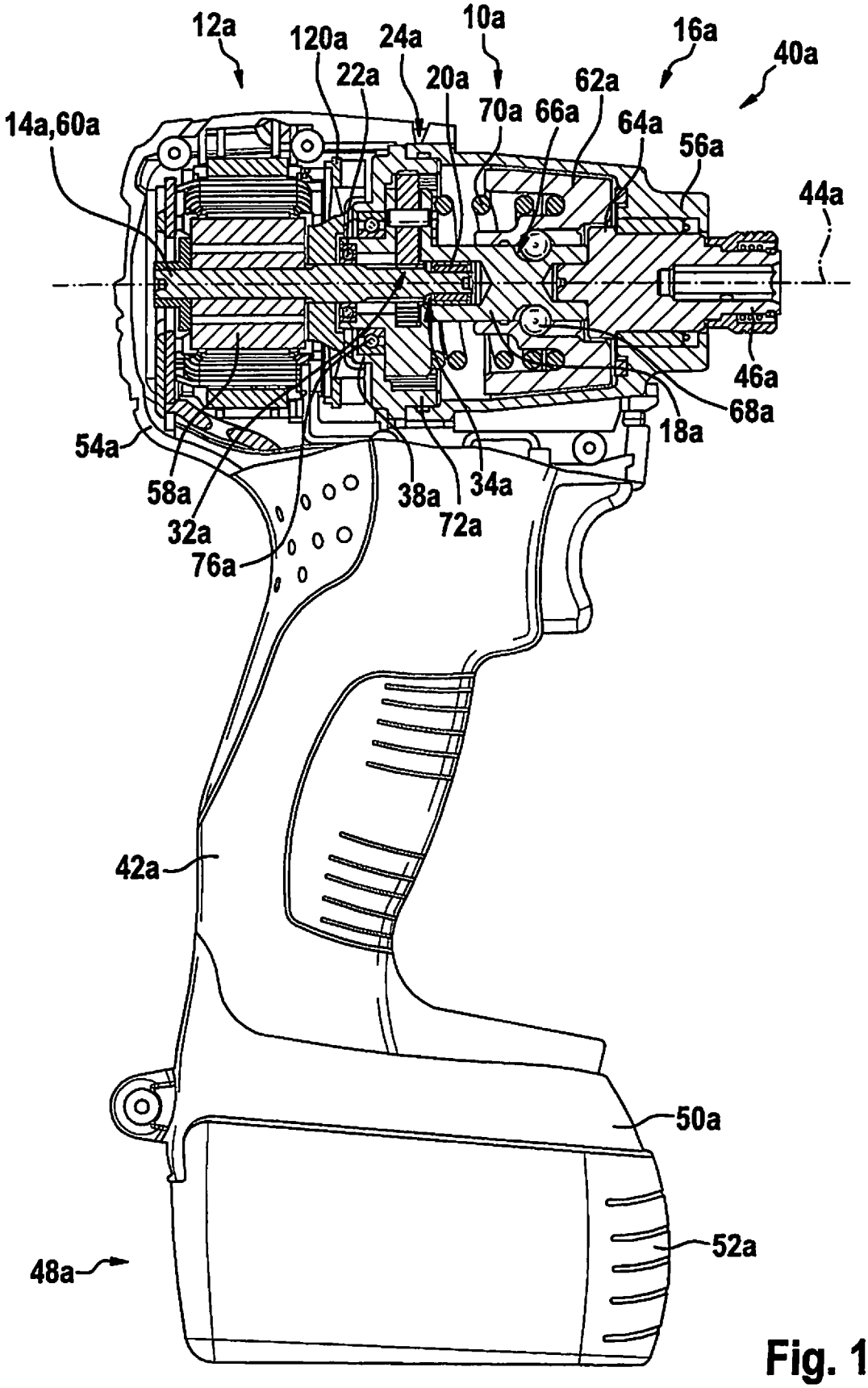
FIG. 1 shows a schematic partial sectional view of a handheld power tool, which is designed as a rotary impact screwdriver.

FIG. 1 shows a handheld power tool 40*a*, which is designed as a rotary impact screwdriver, in a schematic partial sectional view. Hand-held power tool 40*a* is designed as a cordless rotary impact screwdriver. Hand-held power tool 40*a* includes a handle 42*a* which extends at least essentially perpendicularly in relation to a rotation axis 44*a* of a tool holder 46*a*, which is provided for holding an insert tool (not shown here), of handheld power tool 40*a*. Handle 42*a* includes a rechargeable battery holder 50*a* on a side 48*a* facing away from handheld power tool 40*a*. Rechargeable battery holder 50*a* is provided for holding a rechargeable battery unit 52*a* for the power supply of handheld power tool 40*a*.

Furthermore, handheld power tool 40*a* includes a handheld power tool device 10*a* having a drive unit 12*a* and a rotary percussion mechanism 16*a*. Handheld power tool device 10*a* has a drive housing 54*a* and a percussion mechanism housing 56*a*. Drive housing 54*a* encloses drive unit 12*a* at least essentially completely. Drive housing 54*a* is designed as a shell housing. Percussion mechanism housing 56*a* encloses rotary percussion mechanism 16*a* at least essentially completely. Drive unit 12*a* is designed as an electrical drive unit, which is supplied with electrical energy with the aid of rechargeable battery unit 52*a*. Drive unit 12*a* is designed as an electric motor 58*a*, which is provided for converting electrical energy provided by rechargeable battery unit 52*a* into rotational energy. Drive unit 12*a* has a drive shaft 14*a*, which is provided for transmitting the rotational energy to rotary percussion mechanism 16*a*. Driveshaft 14*a* is formed by an armature shaft 60*a* of electric motor 58*a*. Armature shaft 60*a* is formed in one piece. Rotary percussion mechanism 16*a* is designed as a V-groove rotary percussion mechanism. Rotary percussion mechanism 16*a* is provided for converting a continuous power output of drive unit 12*a* into a percussion angular momentum. The energy output of drive unit 12*a* is relayed to the insert tool by an impact of a striker 62*a* of rotary percussion mechanism 16*a* on a corresponding anvil 64*a* with the aid of a pulse of high power intensity. Anvil 64*a* is formed in one piece with tool holder 46*a*. Striker 62*a* is mounted in such a way that an axial movement and a radial movement are possible. The control of the axial movement is carried out by V-shaped grooves 66*a* and driving balls 68*a*. A spring 70*a* ensures the restoring movement of striker 62*a*. Moreover, handheld power tool device 10*a* has a fan wheel 120*a*, which is situated between drive unit 12*a* and rotary percussion mechanism 16*a*. Alternatively, fan wheel 120*a* may also be situated on a side of drive unit 12*a* facing away from rotary percussion mechanism 16*a*. Fan wheel 120*a* is provided in particular for producing a cooling air flow for cooling rotary percussion mechanism 16*a* and/or drive unit 12*a*. Fan wheel 120*a* is rotatably fixedly situated on drive shaft 14*a* of drive unit 12*a*.

Rotary percussion mechanism 16*a* has an intermediate shaft 18*a*, which is oriented at least essentially flush with respect to drive shaft 14*a*. Furthermore, handheld power tool device 10*a* has two bearings 20*a*, 22*a* for mounting driveshaft 14*a*. Bearings 20*a*, 22*a* for mounting drive shaft 14*a* are situated on a side of drive unit 12*a* facing toward rotary percussion mechanism 16*a*. Bearings 20*a*, 22*a* for mounting driveshaft 14*a* are situated inside rotary percussion mechanism 16*a*. Driveshaft 14*a* is mounted at least partially inside intermediate shaft 18*a*. Intermediate shaft 18*a* has a receptacle recess 34*a*, which is provided for at least partially accommodating driveshaft 14*a*. Receptacle recess 34*a* extends at least essentially along a rotation axis 44*a* of intermediate shaft 18*a*. Driveshaft 14*a* protrudes in an installed state at least partially into intermediate shaft 18*a*, in particular into receptacle recess 34*a* of intermediate shaft 18*a*.

Bearings 20*a*, 22*a* for mounting driveshaft 14*a* are situated inside intermediate shaft 18*a*. Bearings 20*a*, 22*a* for mounting driveshaft 14*a* are designed as antifriction bearings.

Rotary percussion mechanism 16*a* has at least one single-stage planetary gear 24*a* having a plurality of planetary wheels 26*a*, 28*a*, 30*a*, which are interlocked with drive shaft 14*a*. A toothing 32*a* of driveshaft 14*a* with planetary wheels 26*a*, 28*a*, 30*a* is situated between bearings 20*a*, 22*a* for mounting driveshaft 14*a*. Planetary gear 24*a* includes at least one annulus gear 72*a*. Furthermore, rotary percussion mechanism 16*a* includes a percussion mechanism cover 38*a*. Percussion mechanism cover 38*a* is situated between drive unit 12*a* and planetary gear 24*a*. In particular, percussion mechanism 38*a* is provided for at least largely closing rotary percussion mechanism 16*a* in the direction of drive unit 12*a*. Percussion mechanism cover 38*a* is formed in one piece with annulus gear 72*a*. Percussion mechanism 38*a* and annulus gear 72*a* are at least essentially made of a metallic material, in particular a metallic sintered material.

Handheld power tool device 10*a* furthermore includes an intermediate shaft bearing 76*a* for mounting intermediate shaft 18*a*. Intermediate shaft bearing 76*a* is designed as an antifriction bearing. Alternatively, intermediate shaft bearing 76*a* may be designed as a slide bearing. Intermediate shaft bearing 76*a* is designed as a radial bearing, which is provided for rotatably mounting intermediate shaft 18*a* in percussion mechanism cover 38*a*. Intermediate shaft bearing 76*a* is situated at least partially inside a percussion mechanism cover 38*a* of rotary percussion mechanism 16*a*.

Figure 2:
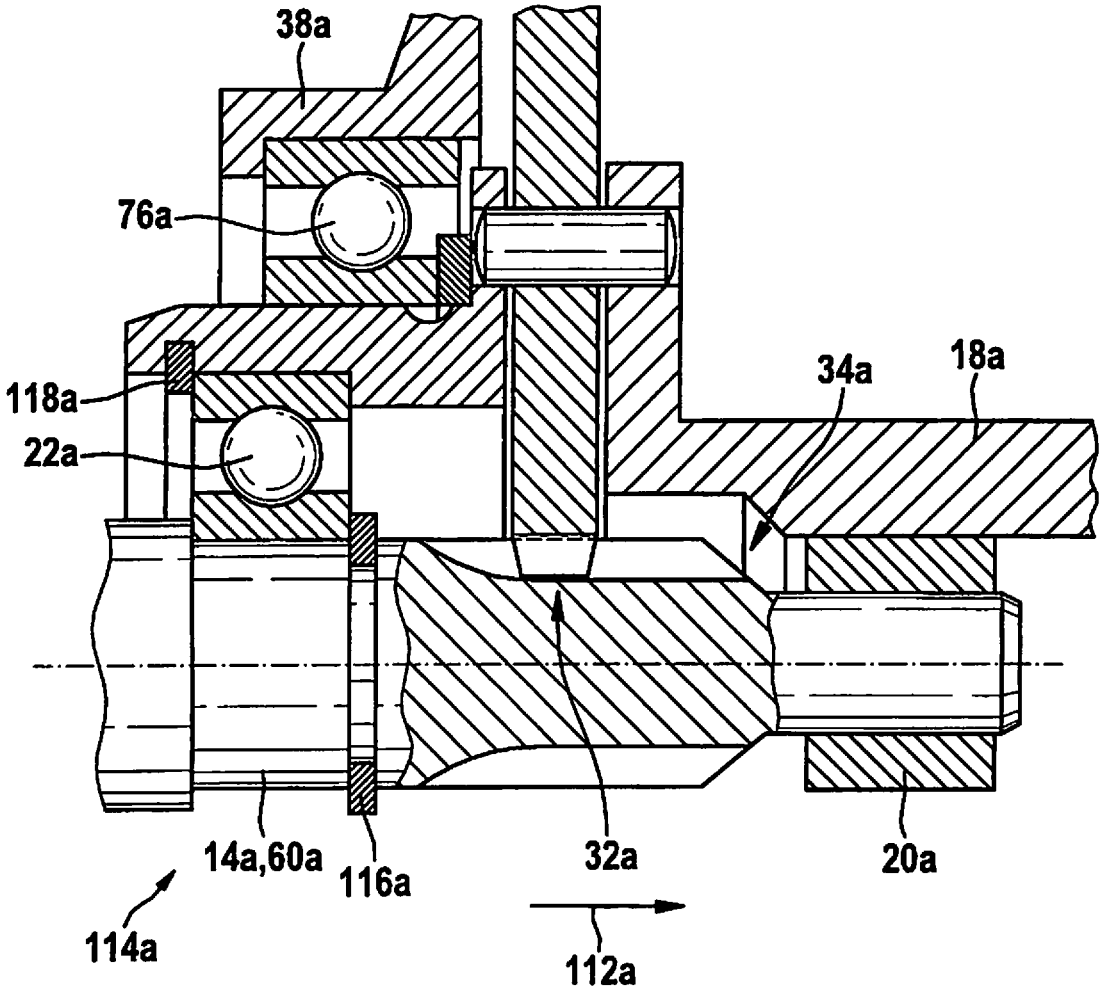
FIG. 2 shows a detail view of a mounting of a driveshaft of the handheld power tool.

FIG. 2 shows a detail view of the mounting of driveshaft 14*a*. Driveshaft 14*a* is situated partially inside receptacle recess 34*a* of intermediate shaft 18*a*. Toothing 32*a* of driveshaft 14*a* with planetary wheels 26*a*, 28*a*, 30*a* takes place inside intermediate shaft 18*b*. Bearings 20*a*, 22*a* for mounting driveshaft 14*a* are situated on both sides of toothing 32*a*. A bearing 20*a* for mounting driveshaft 14*a* is situated behind toothing 32*a* along an insertion direction 112*a* of driveshaft 14*a* into receptacle recess 34*a*. Bearing 20*a* is designed as an antifriction bearing, in particular as a needle bearing. Bearing 20*a* may be pressed into receptacle recess 34*a* in particular. Second bearing 22*a* for mounting driveshaft 14*a* is situated in front of toothing 32*a* along insertion direction 112*a* of driveshaft 14*a* into receptacle recess 34*a*. Second bearing 22*a* is situated directly at an insertion opening 114*a* of receptacle recess 34*a*. Second bearing 22*a* is designed as an antifriction bearing, in particular as a ball bearing. Second bearing 22*a* is installed with the aid of a sliding fit and is secured in its position with the aid of two securing elements 116*a*, 118*a*, in particular with the aid of snap rings.

Figure 3:
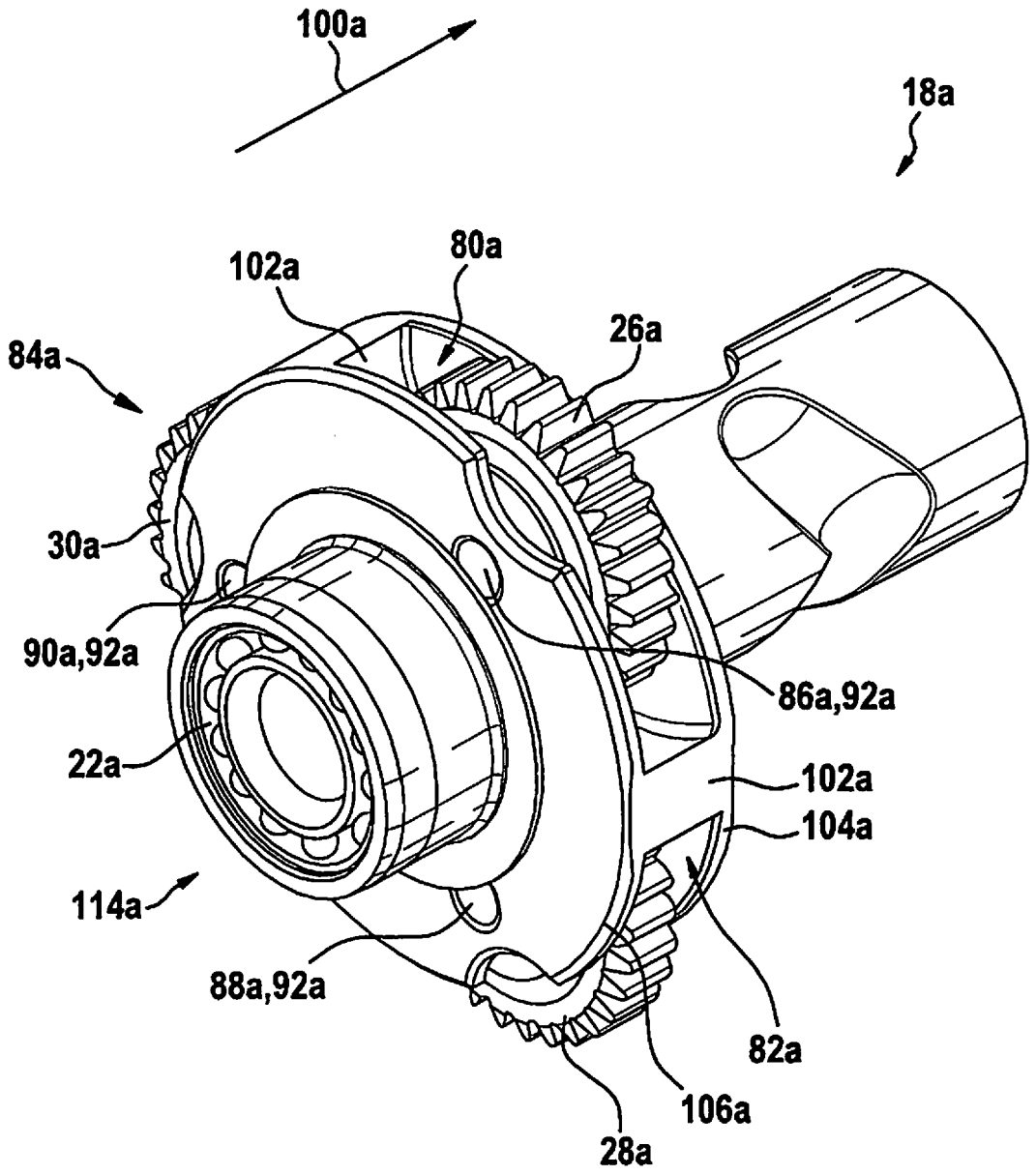
FIG. 3 shows an intermediate shaft of the handheld power tool from FIG. 1 in a perspective view.

FIG. 3 shows intermediate shaft 18*a* in a perspective view. Intermediate shaft 18*a* has a plurality of planetary wheel receptacles 80*a*, 82*a*, 84*a* and planetary wheel bearing points 86*a*, 88*a*, 90*a* situated in the circumferential direction. A planetary wheel 26*a*, 28*a*, 30*a*, which is rotatably mounted with the aid of a pin 92*a*, is situated in each planetary wheel receptacle 80*a*, 82*a*, 84*a*. Planetary wheel bearing points 86*a*, 88*a*, 90*a* are each situated offset by at least essentially 120° in relation to one another in the circumferential direction on intermediate shaft 18*a*. Planetary wheel receptacles 80*a*, 82*a*, 84*a* are separated from one another by webs 102*a* extending radially in relation to a longitudinal extension direction 100*a* of intermediate shaft 18*a*. Viewed along longitudinal extension direction 100*a* of intermediate shaft 18*a*, planetary wheel receptacles 80*a*, 82*a*, 84*a* are delimited by two disk-shaped wall elements 104*a*, 106*a*, which are situated at least essentially perpendicularly in relation to longitudinal extension direction 100*a*. Wall elements 104*a*, 106*a* are formed at least essentially circularly. Wall elements 104*a*, 106*a* are formed in one piece with intermediate shaft 18*a*. Second bearing 22*a* is situated directly at an insertion opening 114*a* of receptacle recess 34*a*.

Figure 4:
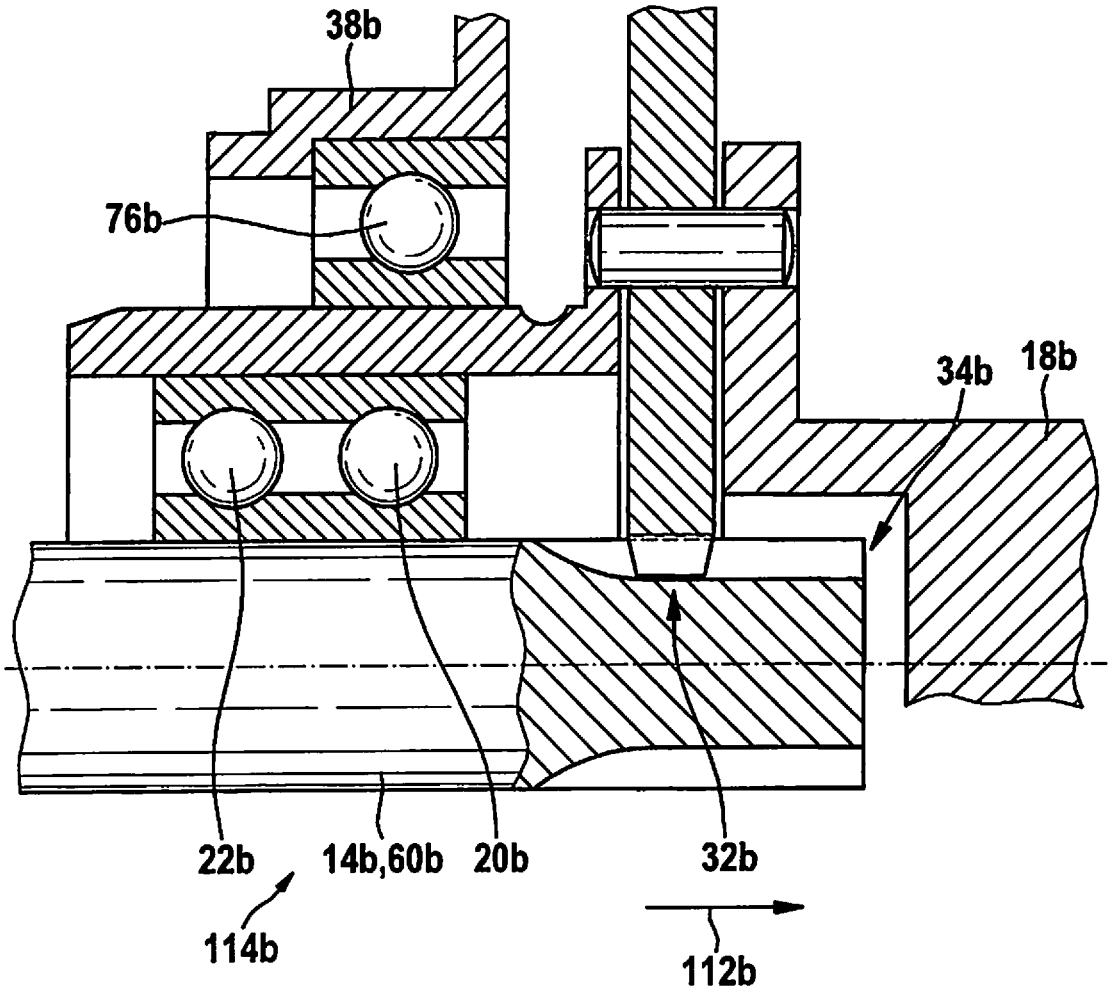
FIG. 4 shows a detail view of an alternative mounting of a driveshaft of the handheld power tool.
Figure 5:
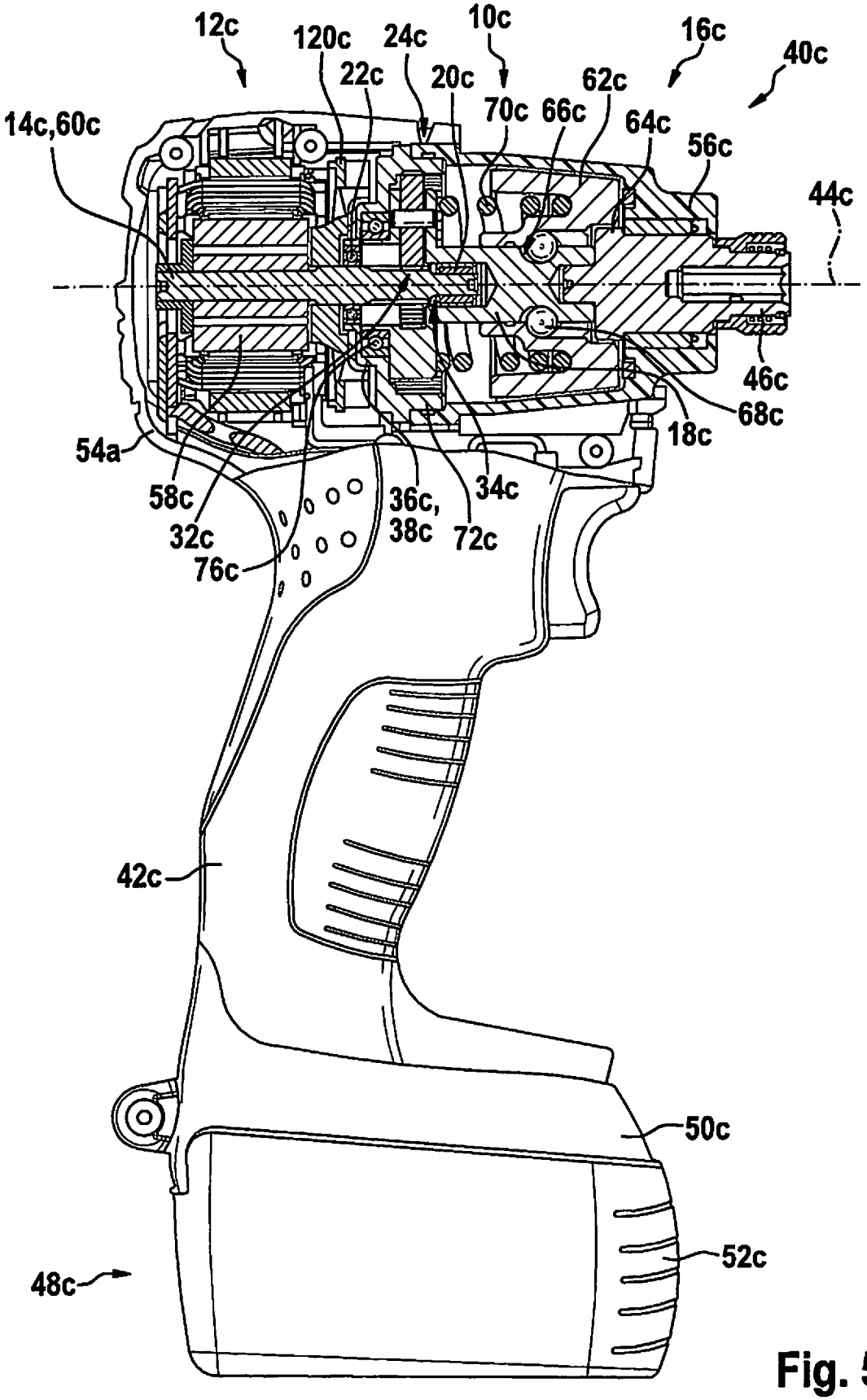
FIG. 5 shows a schematic partial sectional view of an alternative handheld power tool, which is designed as a rotary impact screwdriver.
Figure 6:
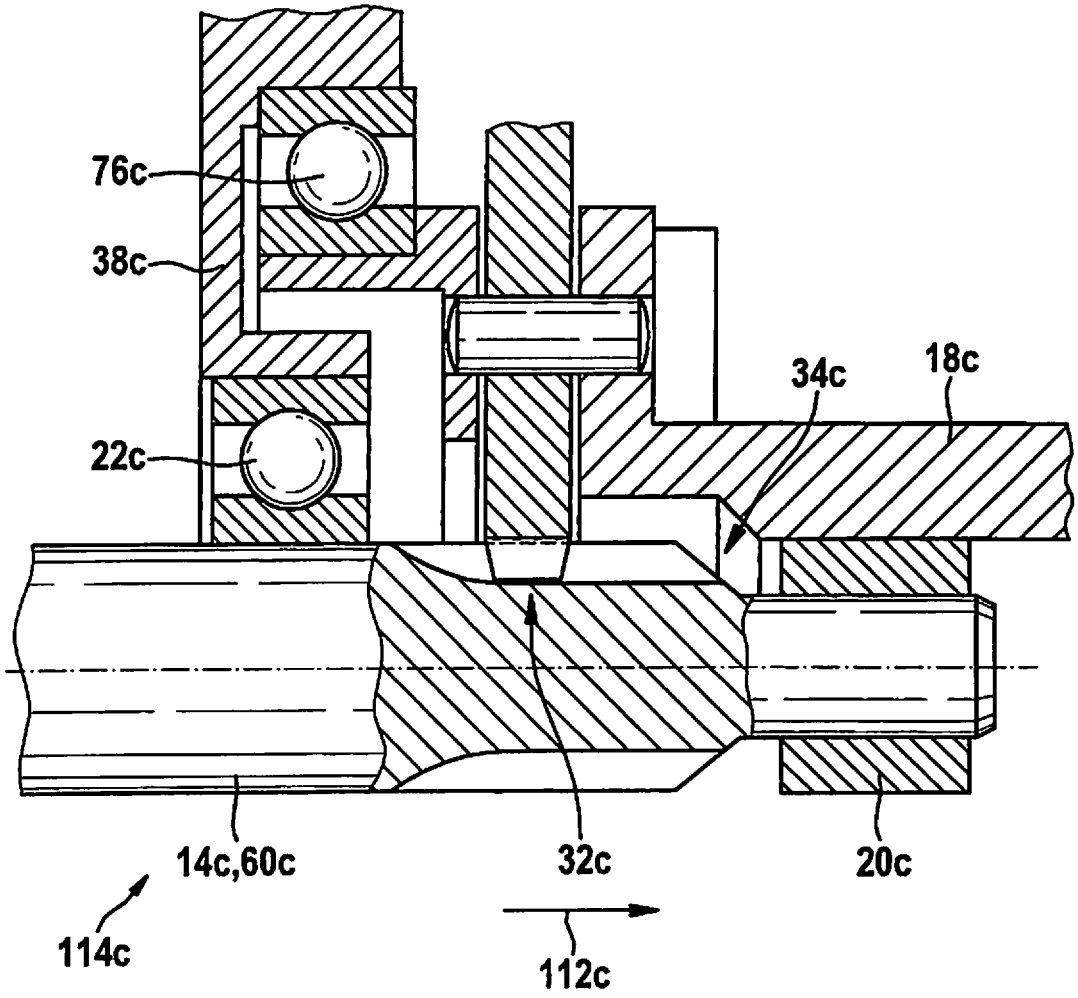
FIG. 6 shows a detail view of a mounting of a driveshaft of the alternative handheld power tool.

Two further exemplary embodiments of the present invention are shown in FIGS. 4 through 6. The following descriptions and the drawings are essentially restricted to the differences between the exemplary embodiments, reference also fundamentally being able to be made to the figures and/or the description of the other exemplary embodiments, in particular of FIGS. 1 through 3, with respect to identically labeled components, in particular with respect to components having identical reference numerals. To differentiate the exemplary embodiments, letter a is appended to the reference numerals of the exemplary embodiments in FIGS. 1 through 3. Letter a is replaced by letters b and c in the exemplary embodiments of FIGS. 4 through 6.

FIG. 4 shows a detail view of an alternative mounting of a driveshaft 14*b*. Driveshaft 14*b* is partially situated inside a receptacle recess 34*b* of an intermediate shaft 18*b*. A toothing 32*b* of driveshaft 14*b* with planetary wheels 26*b*, 28*b*, 30*b* of a planetary gear 24*b* takes place inside intermediate shaft 18*b*. Bearings 20*a*, 22*a* for mounting driveshaft 14*a* are both situated in front of toothing 32*b* along an insertion direction 112*b* of driveshaft 14*b* into a receptacle recess 34*b* of intermediate shaft 18*b*. Bearings 20*b*, 22*b* are situated at an insertion opening 114*b* of receptacle recess 34*b*. Bearings 20*b*, 22*b* are designed as antifriction bearings, in particular as ball bearings. Bearings 20*b*, 22*b* may be pressed into receptacle recess 34*b* in particular. Alternatively or additionally, bearings 20*b*, 22*b* may be secured in their position with the aid of at least one securing element, in particular with the aid of a snap ring, inside receptacle recess 34*b*. Bearings 20*b*, 22*b* are combined here, for example, to form a two-row antifriction bearing, in particular a two-row ball bearing. Alternatively, bearings 20*b*, 22*b*, may be designed as separate, in particular one-row antifriction bearings, in particular ball bearings.

FIG. 5 shows an alternative handheld power tool 40*c*, which is designed as a rotary impact screwdriver, in a schematic partial sectional view. Hand-held power tool 40*c* is designed as a cordless rotary impact screwdriver. Handheld power tool 40*c* includes a handle 42*c*, which extends at least essentially perpendicularly in relation to a rotation axis 44*c* of a tool holder 46*c*, which is provided for holding an insert tool (not shown here), of handheld power tool 40*c*. Handle 42*c* includes a rechargeable battery holder 50*c* on a side 48*c* facing away from handheld power tool 40*c*. Rechargeable battery holder 50*c* is provided for holding a rechargeable battery unit 52*c* for the power supply of handheld power tool 40*c*.

Furthermore, handheld power tool 40*c* includes a handheld power tool device 10*c* having a drive unit 12*c* and a rotary percussion mechanism 16*c*. Drive unit 12*c* is designed as an electrical drive unit, which is supplied with electrical energy with the aid of rechargeable battery unit 52*c*. Drive unit 12*c* is designed as an electric motor 58*c*, which is provided to convert the electrical energy provided by rechargeable battery unit 52*c* into rotational energy. Drive unit 12*c* has a driveshaft 14*c*, which is provided to transmit the rotational energy to rotary percussion mechanism 16*c*. Driveshaft 14*c* is formed by an armature shaft 60*c* of electric motor 58*c*. Armature shaft 60*c* is formed in one piece. Rotary percussion mechanism 16*b* is designed as a V-groove rotary percussion mechanism. Rotary percussion mechanism 16*c* is provided for converting a continuous power output of drive unit 12*c* into a percussion angular momentum.

Rotary percussion mechanism 16*c* has an intermediate shaft 18*c*, which is oriented at least essentially flush with respect to driveshaft 14*c*. Furthermore, handheld power tool device 10*c* has two bearings 20*c*, 22*c* for mounting driveshaft 14*c*. Bearings 20*c*, 22*c* for mounting driveshaft 14*c* are situated on a side of drive unit 12*c* facing away from rotary percussion mechanism 16*c*. Bearings 20*c*, 22*c* for mounting driveshaft 14*c* are situated inside rotary percussion mechanism 16*c*. Driveshaft 14*c* is mounted at least partially inside intermediate shaft 18*c*. Intermediate shaft 18*c* has a receptacle recess 34*c*, which is provided for at least partially accommodating driveshaft 14*c*. Receptacle recess 34*c* extends at least essentially along a rotation axis 44*c* of intermediate shaft 18*c*. Driveshaft 14*c* protrudes in an installed state at least partially into intermediate shaft 18*c*, in particular into receptacle recess 34*c* of intermediate shaft 18*c*. Bearings 20*c*, 22*c* for mounting driveshaft 14*c* are designed as antifriction bearings. A bearing 20*c* for mounting driveshaft 14*c* is situated inside intermediate shaft 18*b*. Second bearing 22*c* for mounting driveshaft 14*c* is situated inside an element 36*c*, which is different from intermediate shaft 18*c*, of rotary percussion mechanism 16*c*.

Rotary percussion mechanism 16*c* has at least one single-stage planetary gear 24*c* having a plurality of planetary wheels 26*c*, 28*c*, 30*c* interlocked with driveshaft 14*c*. Toothing 32*c* of driveshaft 14*c* with planetary wheels 26*c*, 28*c*, 30*c* is situated between bearings 20*c*, 22*c* for mounting driveshaft 14*c*. Planetary gear 24*c* includes at least one annulus gear 72*c*. Furthermore, rotary percussion mechanism 16*c* includes a percussion mechanism cover 38*c*. Percussion mechanism cover 38*c* is situated between drive unit 12*c* and planetary gear 24*c*. Percussion mechanism cover 38*c* is provided in particular for at least largely closing rotary percussion mechanism 16*c* in the direction of drive unit 12*c*. Percussion mechanism cover 38*c* is formed in one piece with annulus gear 72*c*. Percussion mechanism cover 38*c* and annulus gear 72*c* are at least essentially made of a metallic material, in particular a metallic sintered material. Second bearing 22*c* for mounting driveshaft 14*c* is situated inside percussion mechanism cover 38*c*.

FIG. 6 shows a detail view of the mounting of driveshaft 14*c*. Driveshaft 14*c* is situated partially inside receptacle recess 34*c* of intermediate shaft 18*a*. Toothing 32*c* of driveshaft 14*c* with planetary wheels 26*c*, 28*c*, 30*c* takes place inside intermediate shaft 18*c*. Bearings 20*c*, 22*c* for mounting driveshaft 14*c* are situated on both sides of toothing 32*c*. A bearing 20*c* for mounting driveshaft 14*c* is situated behind toothing 32*c* along an insertion direction 112*c* of driveshaft 14*c* into receptacle recess 34*c*. Bearing 20*c* is designed as an antifriction bearing, in particular as a needle bearing. Bearing 20*c* may be pressed into receptacle recess 34*c* in particular. Second bearing 22*c* for mounting driveshaft 14*c* is situated in front of toothing 32*c* along insertion direction 112*c* of driveshaft 14*c* into receptacle recess 34*c*. Second bearing 22*c* is situated in percussion mechanism cover 38*c*. Second bearing 22*c* is designed as an antifriction bearing, in particular as a ball bearing. Second bearing 22*c* is installed with the aid of a press fit. Alternatively, second bearing 22*c* may be secured in its position in percussion mechanism cover 38*c* with the aid of at least one securing element, in particular with the aid of a snap ring.

What is claimed is:

1. A handheld power tool device, comprising:

a drive unit including at least one driveshaft;

a drive housing essentially completely enclosing or completely enclosing the drive unit;

at least one rotary percussion mechanism, which includes at least one intermediate shaft oriented essentially flush or flush with respect to the driveshaft;

wherein the at least one intermediate shaft is provided for transmitting a force and/or movement generated by the drive unit directly and/or indirectly to an output shaft;

a percussion mechanism housing enclosing essentially completely or completely the rotary percussion mechanism;

a percussion mechanism cover provided for closing at least a majority of the rotary percussion mechanism in a direction of the drive unit; and at least two bearings for mounting the driveshaft, wherein the at least two bearings for mounting the driveshaft are situated on a side of the drive unit facing toward the rotary percussion mechanism, wherein the at least two bearings for mounting the driveshaft are situated inside the at least one intermediate shaft.

2. The handheld power tool device as recited in claim 1, wherein the bearings for mounting the driveshaft are situated inside the rotary percussion mechanism.

3. The handheld power tool device as recited in claim 1, wherein the rotary percussion mechanism includes at least one planetary gear having a plurality of planetary wheels interlocked with the driveshaft, toothing of the driveshaft with the planetary wheels being situated between the bearings for mounting the driveshaft.

4. The handheld power tool device as recited in claim 1, wherein the driveshaft is mounted at least partially inside the intermediate shaft.

5. The handheld power tool device as recited in claim 1, wherein the intermediate shaft includes at least one receptacle recess, which is provided for at least partially accommodating the driveshaft.

6. The handheld power tool device as recited in claim 1, wherein at least one bearing of the at least two bearings for mounting the driveshaft is situated inside the intermediate shaft.

7. The handheld power tool device as recited in claim 1, wherein at least one bearing of the at least two bearings for mounting the driveshaft is situated inside at least one element of the rotary percussion mechanism different from an intermediate shaft.

8. The handheld power tool device as recited in claim 1, wherein the rotary percussion mechanism includes the at least one percussion mechanism cover and at least one bearing of the at least two bearings for mounting the driveshaft is situated inside the percussion mechanism cover.

9. The handheld power tool device as recited in claim 1, wherein the percussion mechanism cover is situated between the drive unit and the rotary percussion mechanism.

10. The handheld power tool device as recited in claim 1, wherein the percussion mechanism cover is formed in one piece with an annulus gear of a planetary gear.

11. The handheld power tool device as recited in claim 1, further comprising:

An intermediate shaft bearing for rotatably mounting the at least one intermediate shaft, wherein the intermediate shaft bearing is situated at least partially inside the percussion mechanism cover of the rotary percussion mechanism.

12. The handheld power tool device as recited in claim 1, wherein the at least two bearings for mounting the drive shaft are situated in a radial direction between the driveshaft and the at least one intermediate shaft.

13. A handheld power tool including at least one handheld power tool device, the handheld power tool device comprising:

a drive unit including at least one driveshaft;

a drive housing essentially completely enclosing or completely enclosing the drive unit;

at least one rotary percussion mechanism, which includes at least one intermediate shaft oriented essentially flush or flush with respect to the driveshaft; wherein the at least one intermediate shaft is provided for transmitting a force and/or movement generated by the drive unit directly and/or indirectly to an output shaft;

a percussion mechanism housing enclosing essentially completely or completely the rotary percussion mechanism;

a percussion mechanism cover provided for closing at least a majority of the rotary percussion mechanism in a direction of the drive unit; and at least two bearings for mounting the driveshaft, wherein the at least two bearings for mounting the driveshaft are situated on a side of the drive unit facing toward the rotary percussion mechanism, wherein the at least two bearings for mounting the driveshaft are situated inside the at least one intermediate shaft.

14. A handheld power tool including at least one handheld power tool device, the handheld power tool device comprising:

a drive unit including at least one driveshaft;

a drive housing essentially completely or completely enclosing the drive unit;

at least one rotary percussion mechanism, which includes at least one intermediate shaft oriented essentially flush or flush with respect to the driveshaft;

wherein the at least one intermediate shaft is provided for transmitting a force and/or movement generated by the drive unit directly and/or indirectly to an output shaft;

a percussion mechanism housing essentially completely or completely enclosing the rotary percussion mechanism;

a percussion mechanism cover provided for closing at least a majority of the rotary percussion mechanism in a direction of the drive unit; and at least two bearings for mounting the driveshaft, wherein the at least two bearings for mounting the drive-shaft are situated on a side of the drive unit facing toward the rotary percussion mechanism, wherein a first bearing of the at least two bearings for mounting the driveshaft is situated inside the at least one intermediate shaft, in a radial direction between the driveshaft and the percussion mechanism cover, wherein a second bearing of the at least two bearings for mounting the driveshaft is situated in a recess of the percussion mechanism cover, in a radial direction between the at least one intermediate shaft and the percussion mechanism cover.

* * * * *